US005271672A

United States Patent [19]

Reck

[11] Patent Number: 5,271,672

[45] Date of Patent: Dec. 21, 1993

[54] APPARATUS HAVING ROTATING ARMS AND FLUID OUTLET FOR TREATING AND DISCHARGING A MEDIUM

[75] Inventor: Georg Reck, Graz, Austria

[73] Assignee: Andritz-Patentverwaltungs-Gesellschaft m.b.H., Graz, Austria

[21] Appl. No.: 751,443

[22] Filed: Aug. 30, 1991

[30] Foreign Application Priority Data

Sep. 3, 1990 [AT] Austria ..... 1797/90

[51] Int. Cl.[5] ..... B01F 5/04; B01F 7/20; D21C 7/14

[52] U.S. Cl. ..... 366/169; 162/243; 162/246; 366/182; 366/314

[58] Field of Search ..... 366/102, 103, 107, 131, 366/132, 134, 151, 155, 160, 169, 170, 172, 182, 184, 196, 280, 314; 162/57, 243, 246

[56] References Cited

U.S. PATENT DOCUMENTS

| | | | |
|---|---|---|---|
| 1,924,860 | 8/1933 | John et al. . | |
| 2,265,936 | 12/1941 | Cowles | 366/314 X |
| 2,938,824 | 5/1960 | Richter | 162/246 X |
| 2,954,174 | 9/1960 | Polleys | 366/314 X |
| 3,218,040 | 11/1965 | Richter | 162/57 X |
| 3,284,055 | 11/1966 | Johansen | 162/243 X |
| 3,348,390 | 10/1967 | Richter . | |
| 3,579,421 | 5/1971 | Richter | 162/237 |
| 4,060,224 | 11/1977 | Wilson | 366/169 |
| 4,085,002 | 4/1978 | Pettersson | 162/238 |
| 4,093,506 | 6/1978 | Richter | 162/243 X |
| 4,105,494 | 8/1978 | Pettersson | 162/19 |
| 4,158,597 | 6/1979 | Pettersson | 162/238 |
| 4,274,913 | 6/1981 | Kikuiri et al. | 162/243 X |
| 4,427,489 | 1/1984 | Jacobsen | 162/57 |
| 4,432,836 | 2/1984 | Sherman et al. | 162/243 X |
| 4,521,380 | 6/1985 | Fujimoto | 366/169 X |

FOREIGN PATENT DOCUMENTS

| | | |
|---|---|---|
| 387995 | 4/1989 | Austria . |
| 269124 | 6/1988 | European Pat. Off. . |
| 602156 | 9/1934 | Fed. Rep. of Germany . |

OTHER PUBLICATIONS

Technical Association of the Pulp and Paper Industry, New York, N.Y., 1963, p. 317.

*Primary Examiner*—Harvey C. Hornsby
*Assistant Examiner*—Charles Cooley
*Attorney, Agent, or Firm*—Roylance, Abrams, Berdo & Goodman

[57] ABSTRACT

An apparatus for treating and discharging a medium, such as cellulosic fibrous material, in a container or bleaching tower includes an agitating and treating arm coupled to a rotating discharge pipe. A treatment medium or a diluting liquid is dispensed through orifices in the agitating and treating arm disposed in the bottom of the container. The cellulosic fibrous material suspension is discharged from the bleaching tower. The treatment medium or the diluting liquid is fed through the orifices in the agitating and treatment arms as a function of the state variables of the treatment medium and/or the medium to be discharged. The orifices include an obturator to open and close the orifices as a function of the pressure differential between the treatment medium and the medium to be discharged in the area of obturators during the discharge operation.

30 Claims, 8 Drawing Sheets

FIG. 4a
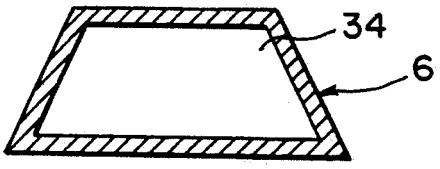
FIG. 4e
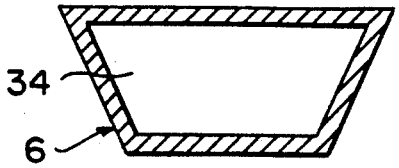
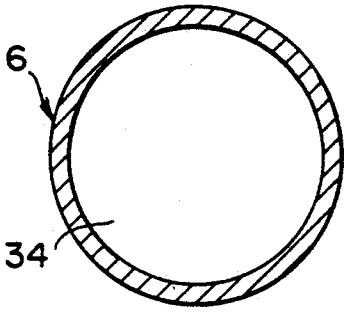
FIG. 4b
FIG. 4f
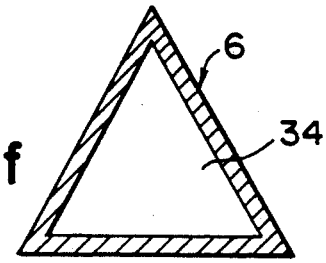
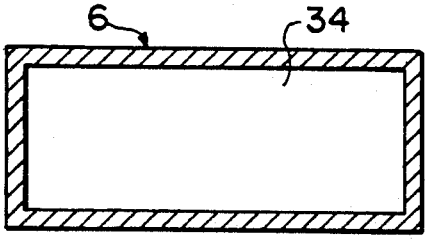
FIG. 4c
FIG. 4g
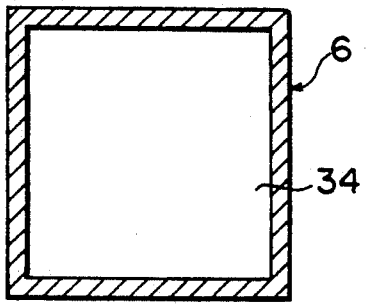
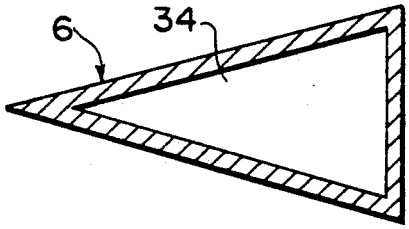
FIG. 4d
FIG. 5a
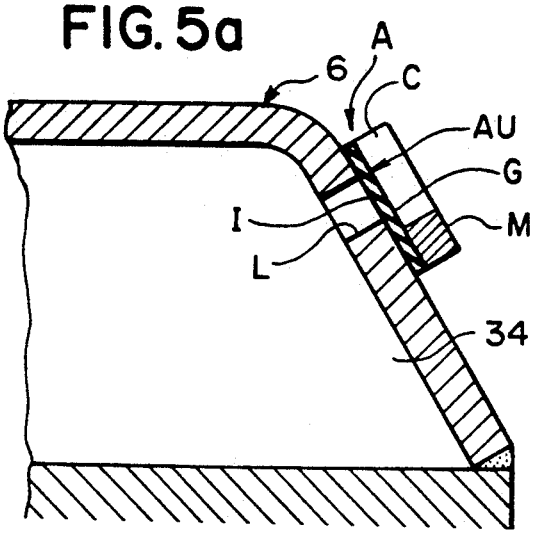
FIG. 5b
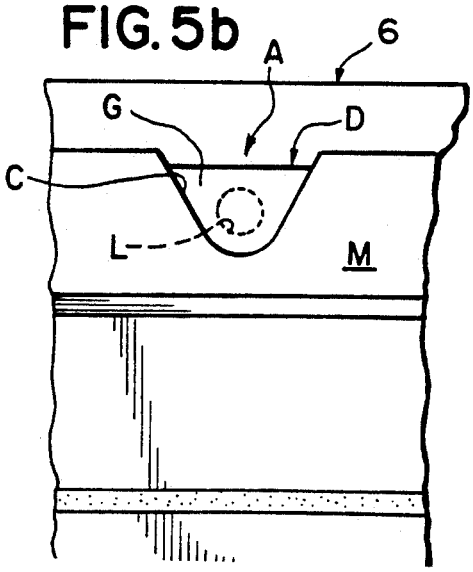

APPARATUS HAVING ROTATING ARMS AND FLUID OUTLET FOR TREATING AND DISCHARGING A MEDIUM

FIELD OF THE INVENTION

The present invention relates to a process and an apparatus for treating and discharging a medium from a container. More specifically, the invention relates to treating the suspension in a bleaching tower prior to discharging with a treatment medium or a diluting liquid via orifices in at least one rotatable agitating organ or arm disposed in the bottom of the bleaching tower, and then discharging the cellulosic, fibrous, material suspension from a bleaching tower used in the cellulose industry.

BACKGROUND OF THE INVENTION

In the past, many apparatuses and processes have been developed for discharging a fibrous, cellulosic, material suspension from a container such as a bleaching tower. These prior apparatuses and processes have numerous disadvantages to them.

One example of a prior discharge assembly is disclosed in Austrian Patent No. 387,995. This Austrian Patent discloses a discharge system in a container with a central bottom discharge and a rotating conveying arm, wherein a central discharge pipe simultaneously serves as a drive for the conveying arm and for conveying the stock. No dilution of the medium to be discharged is provided by this high, consistency, discharge system in the stacking or bleaching tower. In other words, the consistency or the solid content of the discharged medium is the same as the consistency or the solid content of the medium on charging.

In other discharge systems, treatment of the medium to be discharged is accomplished by the two-step bleaching system. In a two-step bleaching system, chemical pulp is typically stored with a medium consistency range of a solids content between from about 12 to 25 percent before being fed to dewatering machines and subsequent to the required dilution of the medium. The discharge consistency of the medium from the stacking or bleaching tower should be adjustable to between 3 and 15 percent to adjust the consistency to the particular dewatering machines disposed downstream. Material of such a discharge consistency could be pumped off by rotary or centrifugal pumps. The required dilution of the discharge of the pulp suspension from the stacking or bleaching tower is usually effected in a separate diluting vat. Circulation of the pulp suspension in this diluting vat is effected by a circulation agitator. This system has the drawback that it requires a separate diluting vat.

In another prior discharge system, the discharge of the pulp suspension from the stacking or bleaching tower is diluted in a diluting zone adjacent the bottom space of the stacking or bleaching tower. In this case, circulation of the pulp suspension in the diluting zone is effected by a circulation agitator. However, in order to support the pulp circulation, a portion of the pulp suspension pumped off after dilution must be recycled to the diluting zone. This discharge system has the drawback that the pulp consistency still ranges from about 5 to 6 percent even after dilution. The uncontrollable zone height results in different dwell times for the pulp suspension in the bleaching tower. Finally, a large diluting space in relation to the bleaching or stacking volume is required.

Another discharge system is disclosed in European Patent Application 269,124, which discloses adding a diluting liquid to the fibrous material suspension or medium through agitating arms disposed in the area of the container bottom to reduce the solids content of the suspension or medium to be discharged. However, this discharge system has the drawback that the orifices in the agitating arms for adding the diluting liquid often become clogged by the medium to be discharged.

SUMMARY OF THE INVENTION

It has been discovered that the drawbacks of the prior discharge systems are avoided by the discharge apparatus according to the invention by effecting the addition of the treatment medium through the orifices in the at least one agitating organ as a function of the state variables of the treatment medium. In particular, the diluting liquid and the medium to be discharged are controlled as a function of the pressure differential between the treatment medium and the medium to be discharged in the area of obturators for these orifices during the discharge operation. In practice, clogging is mainly prevented by adding the treatment medium after the pressure of the treatment medium has been increased above the pressure of the medium to be discharged in the area of the orifices of the agitating organ. It is particularly convenient for the state variables of the treatment medium, i.e., its pressure and/or volume, to be controlled as a function of the consistency of the medium to be discharged. In particular, the control of the treatment medium is effected as a function of the consistency of this medium in the discharge area of the container. A sufficient increase of the pressure and if required also of the amount of the diluting liquid fed through the orifices in the agitating arm not only prevents the aforementioned clogging of the inlet orifices, but naturally also results in a convenient keeping open of the obturators or orifices, and thus also in a considerable enhancement of the discharge, i.e., also when feeding a medium to be discharged of initially high consistency.

The present invention can be attained by a process for treating and discharging a medium from a container with a bottom, comprising the steps of feeding a medium to be discharged into the container, rotating the medium to be discharged with an agitating mechanism disposed in the bottom of the container, feeding a treatment medium into the container through at least one orifice formed in the agitating mechanism, and regulating flow of the treatment medium through the at least one orifice in the agitating mechanism by opening and closing the orifices as a function of the pressure differential between the treatment medium and the medium to be discharged during discharge operation.

According to a further development of the invention, the discharge operation can be further enhanced by providing for an additional feeding of treatment medium or diluting liquid in the discharge area of the container. In particular, the additional treatment medium is fed at the end of discharge area as a function of the consistency of the medium to be discharged.

For the practical performance of the process according to the present invention, the treatment medium or diluting liquid acts on the one side of the closing elements of the obturators or the like, while the medium to be discharged acts on the other side of the closing elements or the like. The obturators are preferably flap valves, disk valves or the like for opening and closing the orifices in the agitating organs or arms.

According to the invention, the solids content of the medium to be discharged, cellulosic fibrous material suspension or medium to be discharged is advantageously adjusted from about 2 to 20 percent. Preferably, the solid content of the medium to be discharged ranges from about 3 to 15 percent. However, the solids content of the medium to be discharged lies in the medium consistency range of from about 12 to 15 percent. In this consistency range, a direct connection to a medium consistency dewatering machine is possible.

According to the present invention, a treatment medium or diluting liquid is advantageously additionally added to the medium or the cellulosic fibrous material suspension in an additional discharging and/or diluting space integrated into the discharge apparatus. The solids content in the medium to be discharged is controlled as necessary to obtain the desired consistency.

The present invention also relates to an apparatus for carrying out the processes previously described, and having a container for receiving a medium to be discharged having a bottom and an outlet; agitating and treating member, located in the container adjacent the outlet, for agitating the medium to be discharged and for dispensing a treatment medium into the medium to be discharged, the agitating and treating member having at least one orifice for dispensing the treatment medium; a feeding system, fluidly coupled to the agitating and treating member, for supplying the treatment medium to the at least one orifice; and obturator, coupled to the agitating and treating member for opening and closing the at least one orifice.

Moreover, an apparatus for the present invention includes at least one agitating organ or arm in a bleaching tower for the treating and/or conveying the medium to be discharged out of the bottom of the bleaching tower. The agitating organ or arm is provided with a plurality of orifices for dispensing a treatment medium such as a diluting liquid. This apparatus is mainly characterized in that these orifices are provided with obturators which automatically adjust during the discharge operation as a function of the state variables of the treatment medium and/or the medium to be discharged. In particular, the obturators open and close as a function of the pressure differential between the treatment medium and the medium to be discharged in the area of obturators for these orifices. This arrangement of the obturators prevent clogging. An advantageous practical solution is obtained by providing the orifices for the treatment medium with elastic covers openable at a pressure of the treatment medium exceeding the pressure of the medium to be discharged in the area of the orifices.

According to a further development of the invention, the agitating organs or agitating arms are fixedly connected by uprights and guiding surfaces to a discharge pipe entrained in rotation by them and piercing the container bottom. In particular, the treatment medium or diluting liquid is introduced through the inlet orifice connected through an annular channel sealed against the discharge pipe to a channel vertically arranged in a rotatable element and in its turn connected to the inlet lines in the agitating organ or arm.

In one embodiment of an apparatus according to the present invention, the annular channel can be divided into an outer annular channel and an inner annular channel by an annular web. The outer annular channel is connected to the inner annular channel by passage orifices in the web. The inner annular channel is connected through feed orifices in the discharge pipe and inlet orifices in the rotatable element to a vertically disposed channel formed by uprights and guiding surfaces.

According to an advantageous embodiment of the invention, at least one stuffing box is provided for sealing the rotatable element of the annular channel against the discharge pipe. Preferably, the stuffing box is lubricated and/or cooled by the diluting liquid or the treatment medium. The diluting liquid is preferably water. The discharge pipe with the vertical channels is connected to a pinion-driven crown gear for rotating the discharge pipe and the agitating organ or arm. The crown gear is supported on a live ring. The crown gear is preferably provided with an axially symmetrical pinion gear drive. Preferably, two diametrically opposed pinion gears are utilized.

According to another advantageous embodiment of the invention, the agitating organ is formed with a plurality of arms with closable orifices. Preferably, a second, shorter part or arm extends at right angles to a first part or arm essentially sweeping the entire container bottom. In particular, curved conveying scoops are provided on a first part or arm for conveying the stock to be discharged at least up to the area of the conveying scoops of a second or further part or arm. The conveying scoops are disposed on the portions of the agitating organ in various radial distances to convey the discharge stock to the central discharge. In particular, the discharge stock of each of the scoop of one part or arm is in each case further conveyed by a subsequent scoop disposed in the area of the part or arm diametrically opposed to the area carrying the scoop.

The apparatus according to the invention can be further characterized by providing the agitating organ with closable orifices disposed or distributed over the entire length of the agitating arm. The agitating arm with closable orifices carries a deflector and/or cover axially projecting into the interior of the container for preventing the direct penetration or flow of the discharge stock into the discharge pipe. Preferably, the deflector and/or cover has a flat shape. The deflector, preferably, extends over the entire length of the agitating arm.

According to a further advantageous embodiment of the invention, the portion of the discharge pipe disposed in the interior of the container is preferably formed of two supports diametrically opposed to one another for mounting and carrying the agitating organ or arm. The free interior space of the discharge pipe is provided with projecting conveying ribs preferably extending at angles to the radial direction and conveniently reaching downwards beyond the end of the discharge pipe.

For obtaining lower consistencies of about 3 percent of solid content, the discharge apparatus is conveniently provided with an additional diluting space with an inlet orifice for adding additional treatment medium or diluting liquid such as water.

According to the present invention, the amount of treatment or diluting liquid added for the precise adjustment of the required solids content in the medium to be discharged, is conveniently adjusted by a control mechanism operated or controlled by the state variables of the medium to be treated. In particular its consistency, influencing the addition of diluting liquid or the like. Any conventional control mechanism can be used.

In practice, it may be particularly convenient for the obturators to be provided with a resilient, elastic, plate or the like covering the orifices for the treatment medium or the diluting liquid, on the side facing the medium to be discharged. The elastic plate is fixed under tension to the agitating organ or arm in such a manner that it clears the orifices in the event that the pressure of the treatment medium or diluting liquid exceeds the pressure of the medium to be discharged in the area of the orifices.

Other objects, advantages and salient features of the invention will become apparent from the following detailed description, which, taken in conjunction with the annexed drawings, discloses several preferred embodiments of the invention.

BRIEF DESCRIPTION OF THE DRAWINGS

The invention is explained on the basis of exemplary embodiments with reference to the accompanying drawings.

Figure 1:
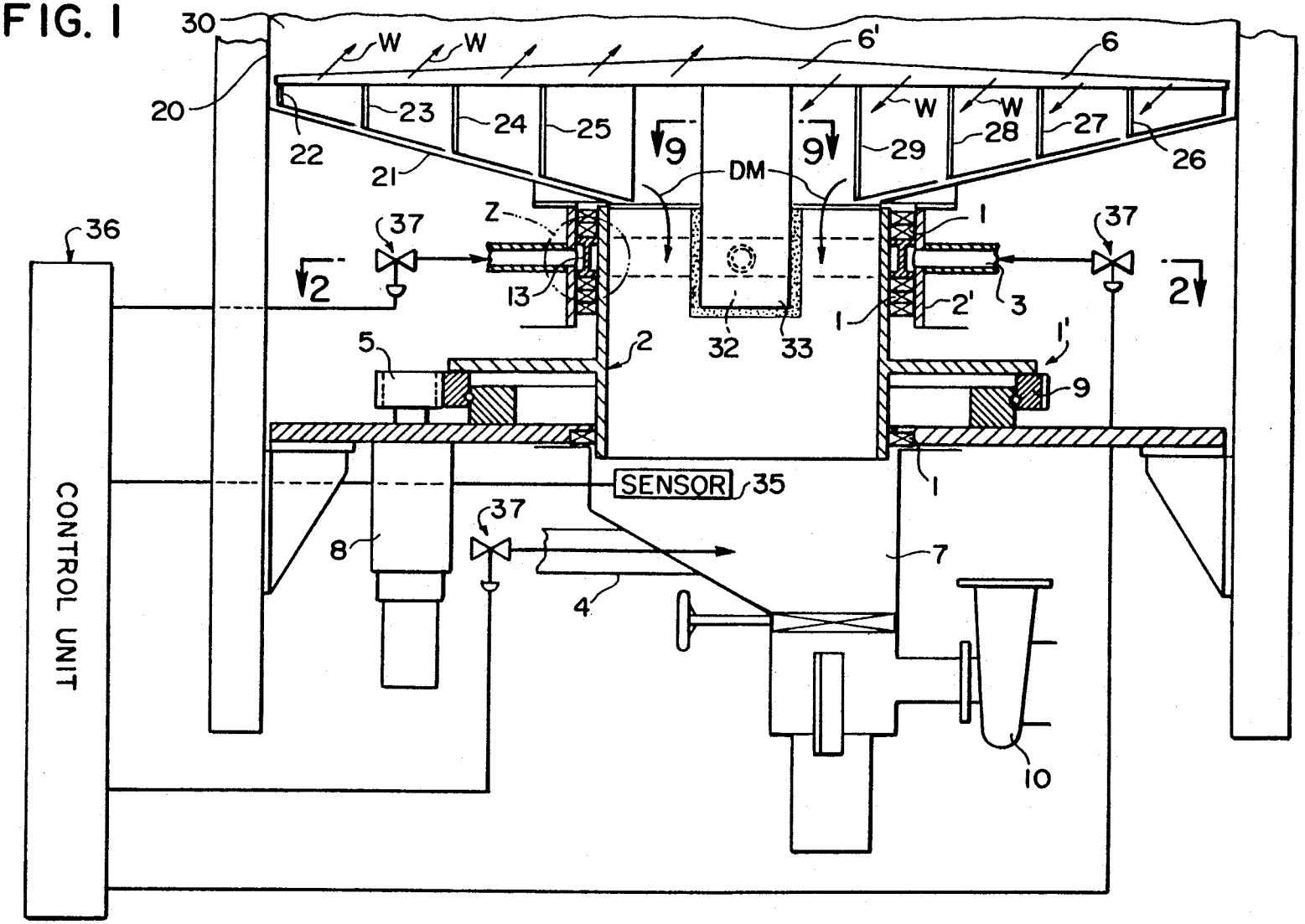
FIG. 1 shows a vertical cross-sectional view of a container bottom with a treatment and discharge apparatus in accordance with the present invention.
Figure 2:
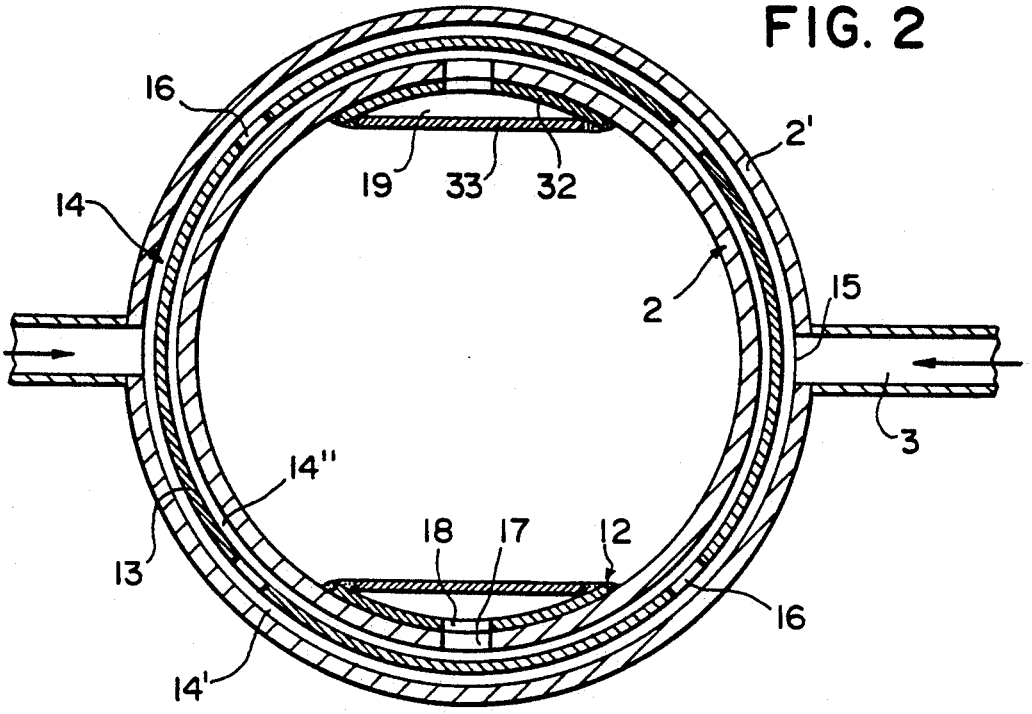
FIG. 2 represents a horizontal cross-sectional view of the present invention taken along line 2—2 in FIG. 1.
Figure 2A:
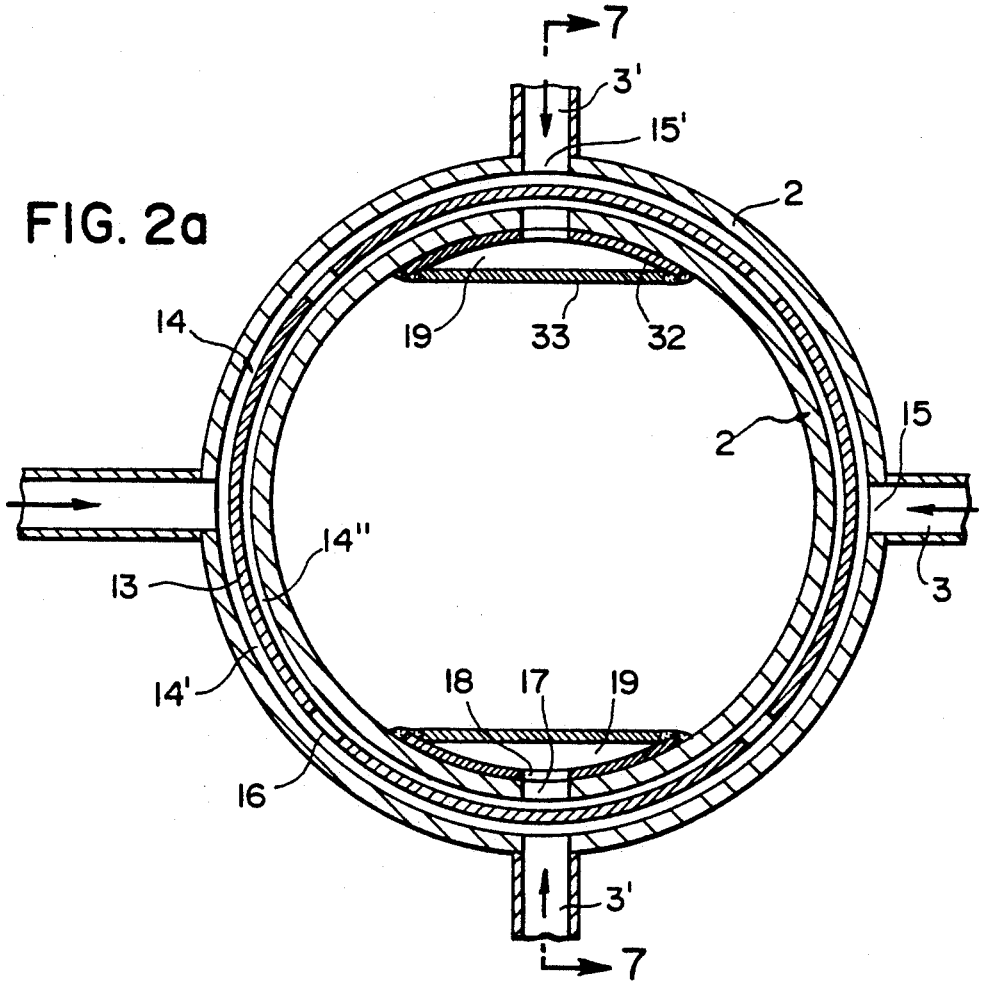
Figure 3:
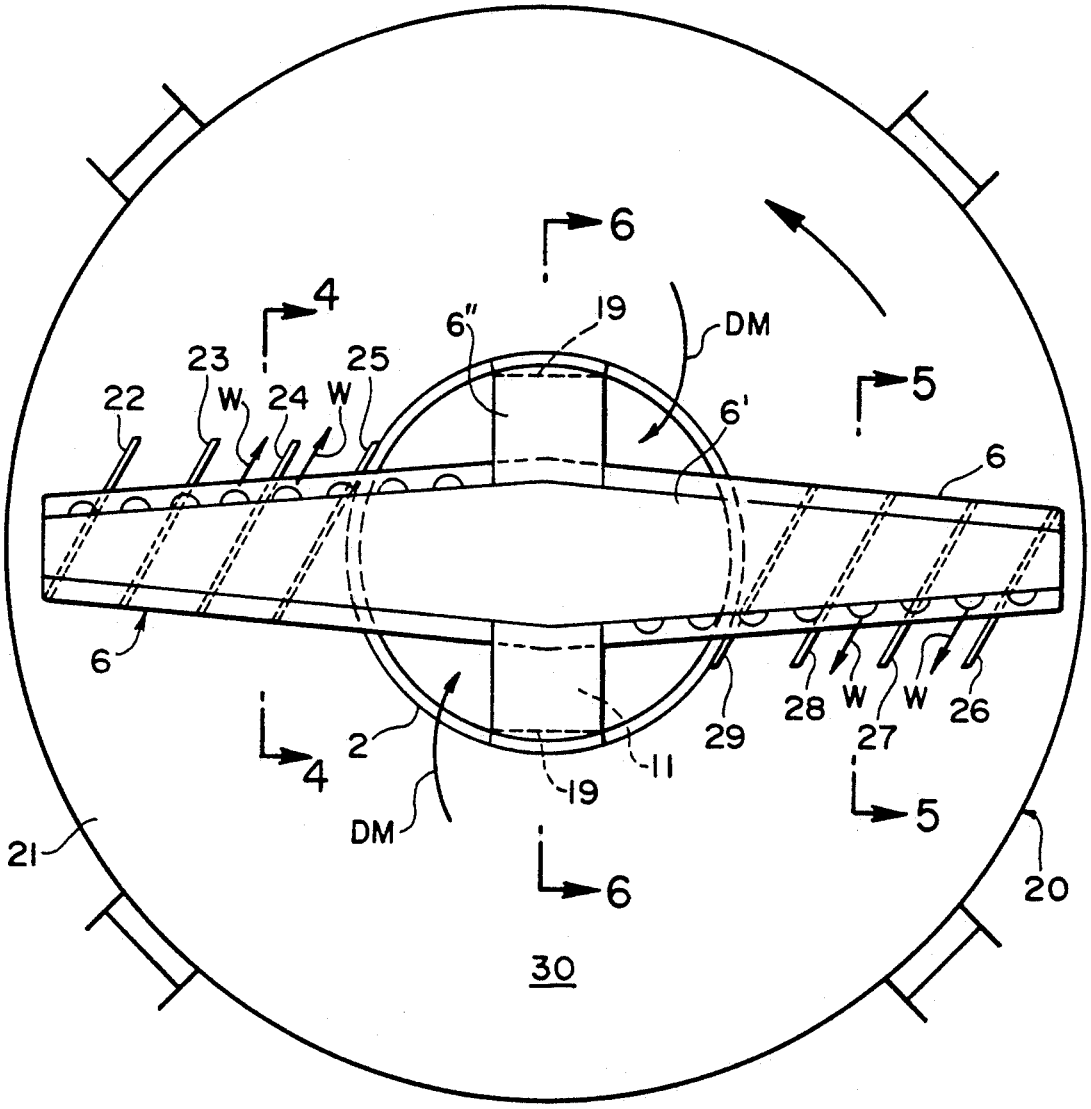
Figure 6:
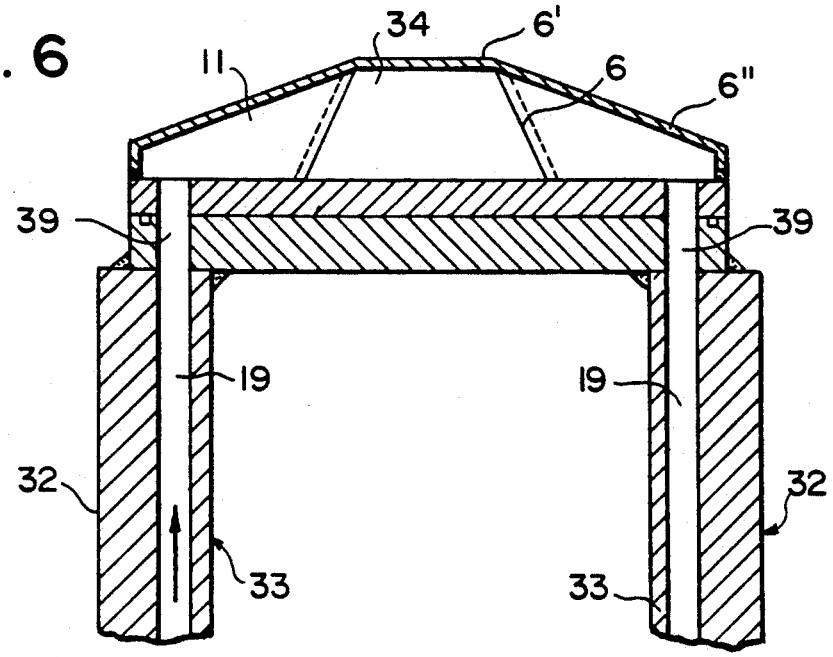
Figure 7:
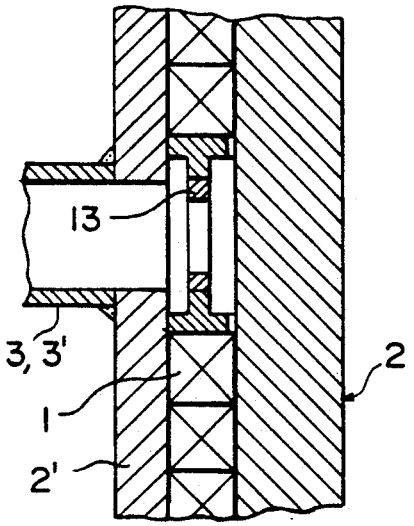

2*a* represents a horizontal cross-sectional view similar to FIG. 2 of alternate embodiment of the present invention having additional feed lines;

FIG. 3 is a top plan view of the treatment and discharge apparatus in the bottom of the container illustrating the agitating arm;

FIG. 4*a* represents an enlarged, vertical cross-sectional view of the agitating arm taken along line 4-4 of FIG. 3;

FIGS. 4*b* to 4*g* each represent an enlarged, vertical cross-sectional views of various embodiments of the agitating arm similar to FIG. 3 illustrating various alternative sectional profiles of the agitating arm;

FIG. 5*a* shows an enlarged, partial cross-sectional view through the agitating arm taken along line 5—5 of FIG. 3 illustrating an obturator;

FIG. 5*b* shows a partial elevational view of the agitating arm of FIG. 5*a* illustrating one of the obturators;

FIG. 6 is partial, vertical cross-sectional view taken along line 6—6 in FIG. 3;

FIG. 7 represents an enlarged, partial, vertical cross-sectional view of area Z in FIG. 1 taken along line 27 in FIG. 2*a;*

Figure 8:
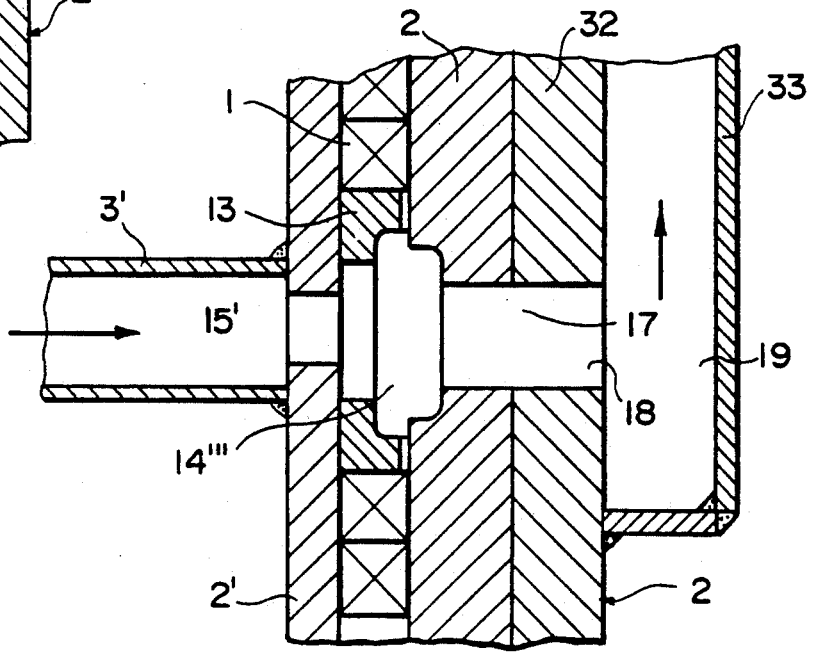
Figure 9:
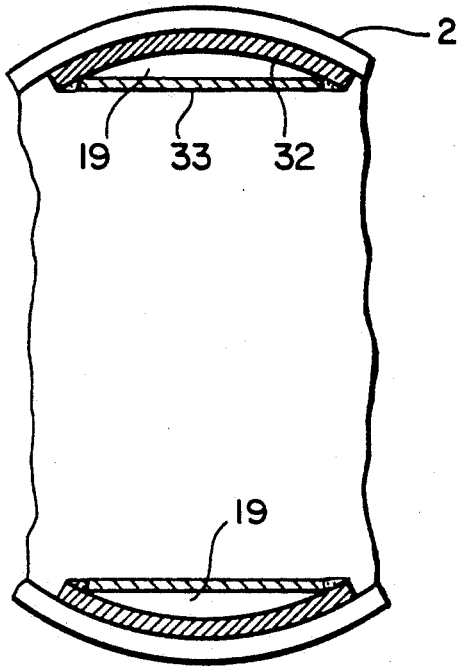
Figure 10:
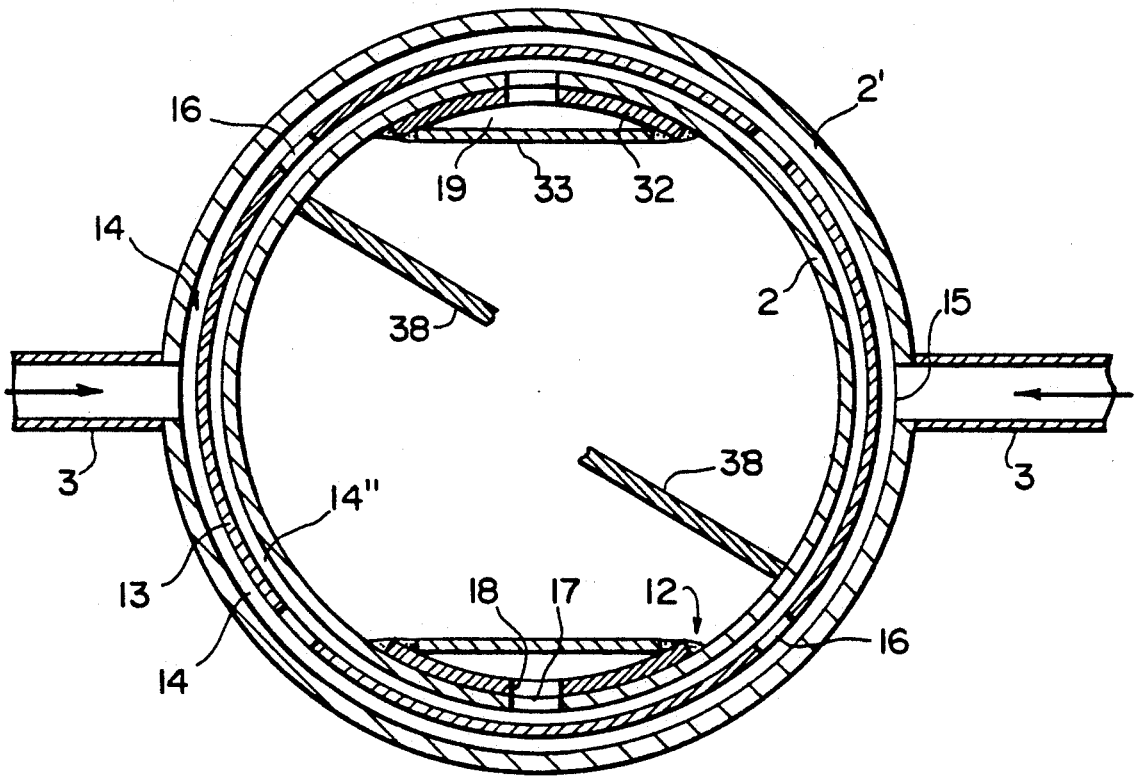
Figure 11:
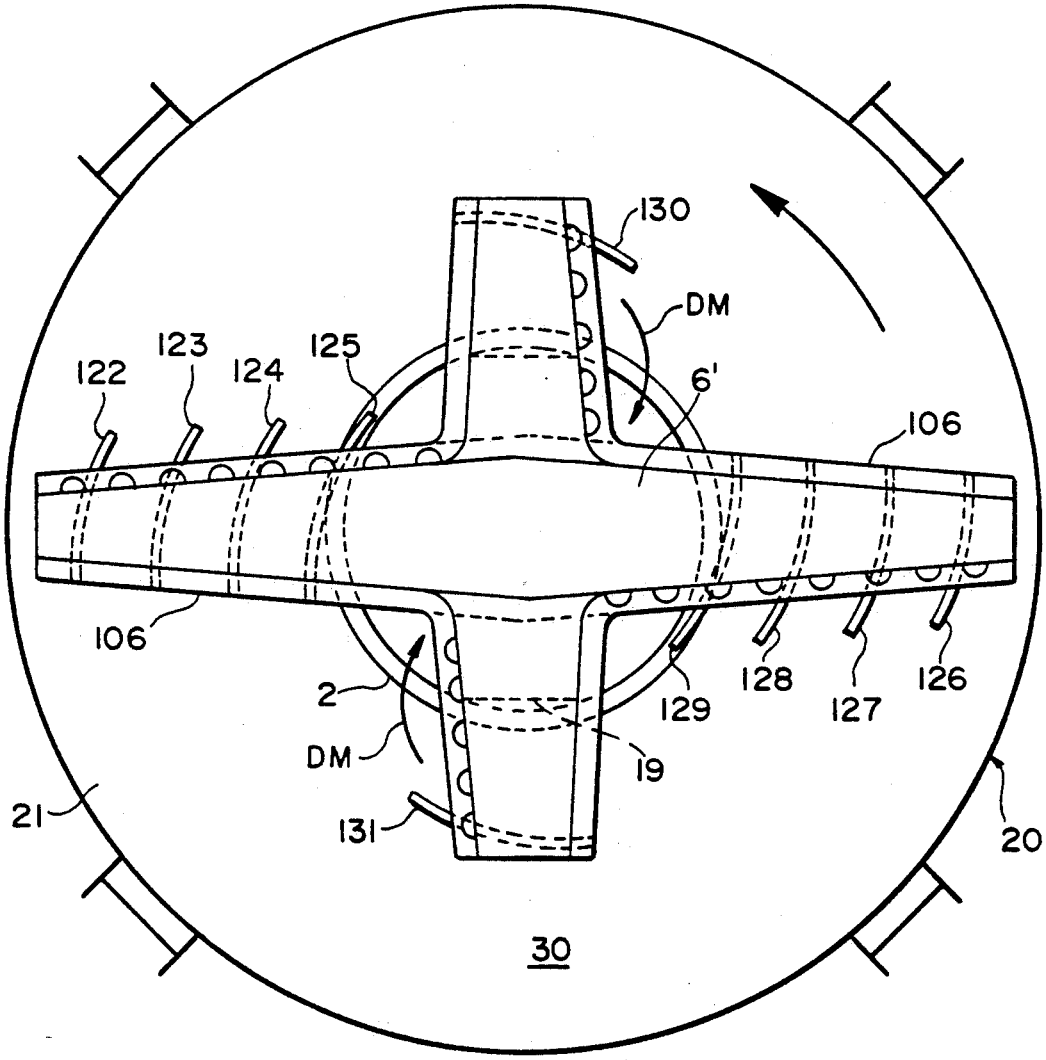
Figure 12:
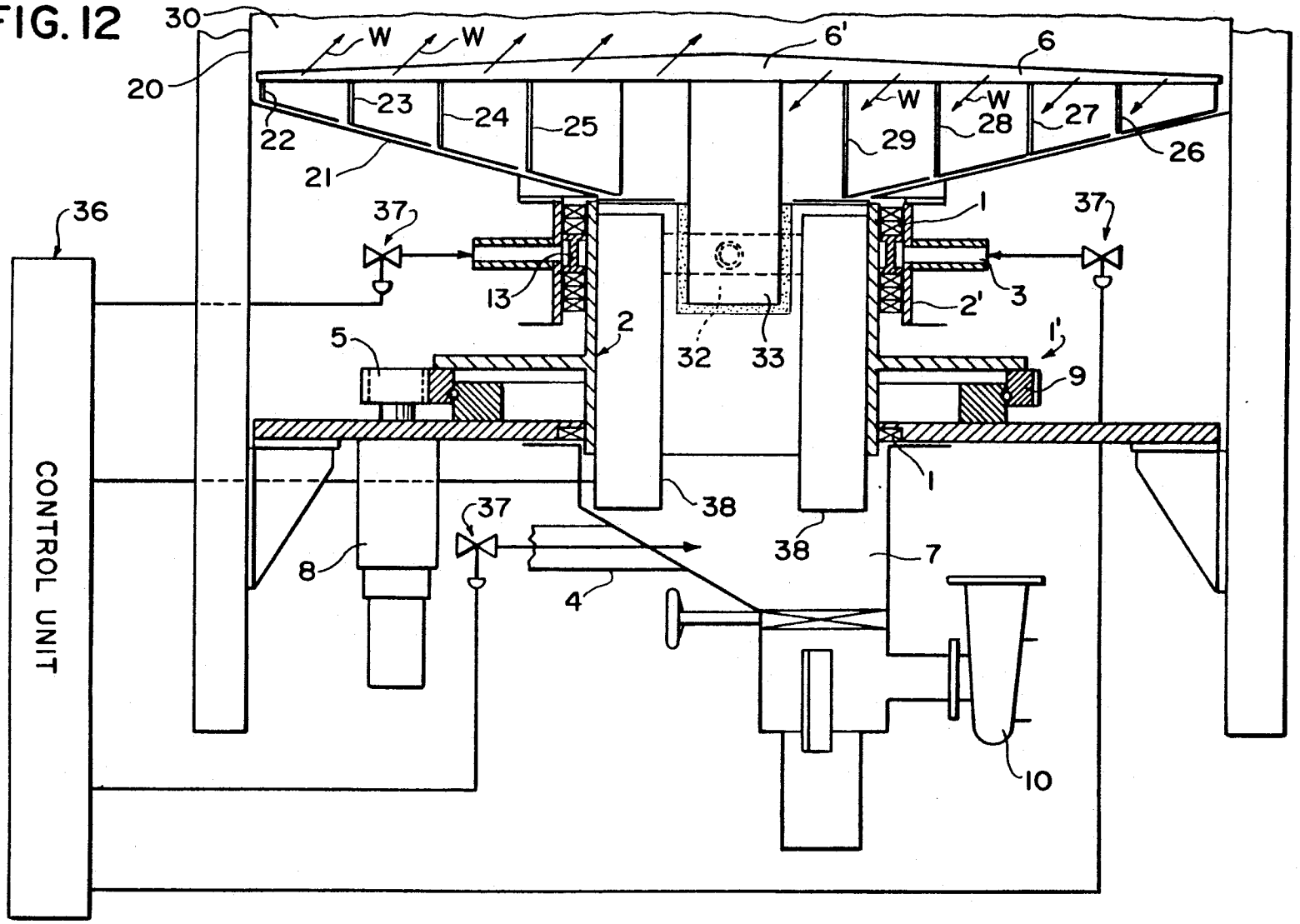

FIG. 8 shows a partial, vertical cross-sectional view in the area of the stuffing box and the passage orifice for the diluting liquid of a modified embodiment as compared to FIGS. 1 to 3 and FIG. 7;

FIG. 9 represents a partial cross-sectional view taken along plane 9—9 of FIG. 1 illustrating a pair of treatment medium channels;

FIG. 10 represents an alternative embodiment of the present invention with conveying ribs located in the rotatably discharge pipe;

FIG. 11 represents another alternative embodiment in accordance with the present invention having an agitating organ with four agitating arms; and FIG. 12 is a vertical cross-sectional view of a further embodiment showing the container and discharge pipe with conveying ribs.

DESCRIPTION OF THE PREFERRED EMBODIMENTS

Referring to the FIGS., in particular FIG. 1, a treatment and discharge system coupled to a container or bleaching tower 20 for treating and discharging a medium such as a cellulosic, fibrous, material suspension. The discharge and treatment system includes an agitating organ or arm 6 disposed in the conical bottom 21 of container 20, a discharge pipe 2 fixedly coupled to agitating arm 6 and a drive assembly 1' for rotatably driving the discharge pipe 2 and agitating arm 6.

Arm 6 sweeps substantially the entire conical container bottom 21 for conveying the discharge medium or stock as indicated by arrows DM. Agitating arm 6 is provided with conveying scoops 22 to 29 for assisting the conveyance of the medium or stock to be discharged. The medium to be discharged is conveyed inwardly towards the top inlet opening of discharge pipe 2 by the inclined position of conveying scoops 22 to 29. During rotation of agitating arm 6, the medium to be discharged is conveyed to the center of container 20 and drops over the upper edge of discharge pipe 2. The agitating arm 6 can be composed of several parts, such as a cross with arms of unequal lengths extending at right angles to one another. Preferably, agitating arm 6 is formed with a deflector 6' projecting into the interior 30 of the container 20.

As seen in FIG. 3, the deflector 6' of arm 6, in plan view, has its outline shaped as two symmetrical trapezoids with a common base line. In the elevational view as seen in FIG. 6, the deflector 6' has the shape of a wedge facing upwardly, i.e., shallowly ascending towards the middle of the agitating arm. The deflector 6' extends over the entire length of the agitating arm 6. Deflector 6' together with a cover 6" provided in the area of the upper end of the discharge pipe 2 prevent the direct dropping of the medium or stock to be discharged into the discharge pipe 2.

The diluting liquid required for the dilution of the medium to be discharged passes via feed lines 3 and/or 3' through inlet orifices 15 and/or 15' into a stationary annular channel 14. Annular channel 14 is formed between the outer surface of rotatable discharge pipe 2 and the inner surface of outer, stationary pipe 2'. Annular channel 14 is divided into an inner space or half 14" and an outer space or half 14' by an annular web 13, or by other suitable elements. Web 13 is preferably a tubular pipe having an annular wall with an I-shaped cross-section and a plurality of inlet openings 16 extending between spaces 14' and 14".

The diluting liquid passes through inlet orifices 15 and/or 15' into the space 14', and then passes through inlet openings 16 disposed in the web 13 into the inner space 14". Then, the diluting liquid passes from inner space 14" through openings 17 and 18 into channel 19 disposed in the rotatable element or discharge pipe 2.

Outer pipe 2' is sealed against the discharge pipe 2 by bearing assemblies or stuffing boxes 1 as seen in FIGS. 1 and 8. Since bearing assemblies or stuffing boxes are well known in the art, thus bearing assemblies or stuffing boxes 1 will not be discussed in detail. The diluting liquid can also be used for the lubrication and cooling of the stuffing boxes 1.

In the rotatable element or discharge pipe 2, the diluting liquid passes through a pair of channels 19 formed by uprights 32 and guiding surfaces 33, and then through inlet orifices 39 into feed lines 11 which are fluidly coupled to interior space 34 of agitating arm 6. The discharge pipe 2 is fixedly connected to the agitating arm 6 via uprights 32.

As seen in FIG. 3, the diluting liquid is passed from agitating arm 6 through orifices L into the bottom area of the container 20 to dilute the medium to be discharged as indicated by arrows W. The orifices L are evenly distributed over the entire length of the agitating arm 6.

FIGS. 4*a* to 4*g* show various transverse cross-sections of the agitating arm 6. The preferred shape trapezoidal as seen in FIG. 4*a*. Alternatively, the agitating arm 6 can be circular (FIG. 4*b*), rectangular (FIG. 4*c*), an isosceles triangle (FIG. 4*d*), a trapezoid turned upside down (FIG. 4*e*), an equilateral triangle (FIG. 4*f*), or a quadrangular (FIG. 4*g*).

As seen in FIGS. 5*a* and 5*b*, a partial representation of an agitating organ or arm 6 is provided with an obturator A on the agitating organ or arm 6 in the area of an orifice L. The obturator A has an elongated rubber plate G placed underneath an equally elongated metal strip M and retained thereon in a conventional manner. Metal strip M and rubber plate G can extend over several orifices L. Preferably, metal strip M and rubber plate G extend over all the orifices L on one side of the agitating organ or arm 6. In the area of the individual orifices L, the metal strip M is provided with an approximately triangular cutout C.

When the pressure of the diluting liquid in the interior 34 of the agitating arm 6 in the area of the orifice L exceeds the pressure of the medium to be discharged on the outside of the agitating arm 6. Then orifices L are uncovered or cleared for permitting the passage of the diluting liquid through orifices L. In other words, if the interior pressure of the agitating arm 6 exceeds the pressure of the medium to be discharged in the container 20, then rubber plate G is stretched or lifted off in the area of the cutout C from the adjacent orifice L or its outer rim to form a slot between rubber plate G and agitating arm 6 through which the diluting liquid flows into the medium to be discharged. The slot is formed on the rim of the rubber plate at D for allowing the diluting liquid to flow into the medium to be discharged.

However, if the pressure of the medium to be discharged, i.e., the pressure exerted by the medium to be discharged on the rubber plate G in the areas of the cutouts C, is greater than the pressure of the diluting liquid, then orifices L remain closed by the rubber plate G. Thus, clogging of the orifices L by the medium to be discharged can be prevented.

Other obturators appropriately responding to the pressure conditions could also be used for the orifices L. In particular, obturators capable of responding to the difference between the pressure of the diluting liquid and the pressure of the medium to be discharged in the area of the orifices L. Other suitable obturators are flap valves, disk valves, non-return check valves and the like.

Moreover, the opening and closing of the orifices L is controlled as a function of the pressure and/or volume of the treatment medium However, the control of this pressure and/or volume is effected as a function of the state variables of the medium to be discharged in diluting space 7 as well as the state variables of the treatment medium. The state variables as used in the specification and the appended claims include, among other things, the chemical composition, the consistency, the temperature and other similar measurable characteristics of the treatment medium and the medium to be discharged. Accordingly, the opening and closing of the orifices L can be effected by using electrically or hydraulically actuated valves which are controlled by corresponding signals representing one or more of the state variables of the treatment medium and/or the medium to be discharged. However, to prevent clogging of the orifices L, these signals are emitted as a function of the pressure conditions.

A control unit 36 is provided for controlling and regulating the flow rates of the treatment medium into interior 30 of container 20 and into diluting space 7. More specifically, control unit 36 operates a plurality of valves 37 in feed lines 3 and 3' and connection pipe 4 to regulate the flow rates therethrough as a function of the consistency of the medium to be discharged in diluting space 7 via a consistency sensor 35 located in diluting space 7.

Control units, valves and sensors, such as control unit 36, valves 37 and sensor 35, are well known in the prior art. Thus, control unit 36, valves 37 and sensor 35 will not be discussed in detail herein.

The uniform distribution of the diluting liquid in the medium to be discharged is further enhanced by the fact that the agitating arm 6 moves simultaneously with the feeding of the diluting liquid. In the instant case, the agitating arm 6 is provided with a deflector 6' directed counter to the feeding direction of the medium to be discharged. Moreover, as seen in FIG. 6, a cover 6'' is provided on the sides of the agitating arm 6 to cover the discharge pipe 2 against the access of the medium from above and to form the top of feed lines 11 for feeding the dilution liquid from the channels 19 into the interior spaces 34 of the agitating arms 6.

The drive assembly 1' of the agitating arm 6 is effected by a gear motor 8 via a pinion gear 5, a crown gear 9 and the aforementioned uprights 32 with the discharge pipe 2. Drive assemblies, such as drive assembly 1' are well known in the prior art, and thus will not be discussed in detail herein.

If the amount of diluting liquid fed via agitating arm 6 to the medium t be discharged is insufficient for the required consistence, then additional diluting liquid can be added via the connection pipe 4 of the diluting space 7. This connection pipe 4 is mainly used for lower consistencies (e.g., of about 3 percent). This connection pipe 4 could also be used for controlling the consistency. The diluted medium to be discharged is pumped off from the diluting space 7 by a suspension fluid pump or a monopump 10.

As seen in FIG. 8, the feeding of the treatment or diluting liquid, and the configuration of the stuffing boxes 1 in this area could be provided with a web 13' abutting the outer wall 2' of the space 14, instead of the web 13 of FIG. 7 which is disposed within the space 14 in approximately the center of space 14. The vertical cross-section of the web 13' is asymmetrically formed. The space 14''' extends into the discharge pipe 2 to provide sufficient space for the distribution of the treatment or diluting liquid.

As seen in FIG. 10, an alternative embodiment according to the present invention is illustrated with a pair of conveying ribs 38 projecting inwardly from discharge pipe 2. Preferably, conveying ribs 38 extend inwardly at angles to the radial direction of discharge pipe 2, and extend downwardly beyond the lower end of discharge pipe 2 into diluting space 7, as shown in FIG. 12.

As seen in FIG. 11, another alternative embodiment according to the present invention is illustrated with a modified agitating organ or arm 106. In this embodiment agitating arm 106 is composed of several arms or parts forming a cross with arms of unequal lengths extending at right angles to one another. The four arms or parts are provided with curved conveying scoops 122–131 for assisting the conveyance of the medium to be discharged. This embodiment, illustrated in FIG. 11, operates in substantially the same manner as the first embodiment illustrated in FIGS. 1–3. Thus, the embodiment of FIG. 11 will not be discussed in detail and similar parts will be given the same reference numerals as the first embodiment.

The invention can also be applied with a different treatment medium instead of the diluting medium, for instance water, is fed to the medium to be discharged.

Although the invention has been described with a certain degree of particularity, it is understood that the present disclosure has been made only by way of example and that numerous changes in the details of construction and the combination and arrangement of parts may be resorted to without departing from the spirit and scope of the invention. Thus, the scope of the invention should not be limited by the foregoing specification, but rather, only by the scope of the claims appended hereto.

What is claimed is:

1. A treatment and discharge system, comprising:

a container for receiving a medium to be discharged, said container having an inlet, a bottom wall and an axial outlet;

a rotatable discharge pipe having a lower end axially disposed in said axial outlet;

agitating and treating means, located in said container adjacent said axial outlet and fixed to said discharge pipe such that said agitating and treating means rotates with said discharge pipe, for agitating the medium to be discharged and for dispensing a treatment medium into the medium to be discharged, said agitating and treating means having at least one orifice for dispensing the treatment medium;

feeding means, fluidly coupled to said discharge pipe and said agitating and treating means, for supplying the treatment medium to said at least one orifice; and obturator means, coupled to said agitating and treating means, for opening and closing said at least one orifice.

2. A treatment and discharge system according to claim 1, wherein said obturator means includes cover means operable to open and close said at least one orifice upon a predetermined pressure differential between the pressure of the treatment medium and the pressure of the medium to be discharged in the area of said cover means during operation.

3. A treatment and discharge system according to claim 1, said at least one orifice comprising a plurality of orifices for dispensing the treatment medium.

4. A treatment and discharge system according to claim 3, wherein said obturator means includes cover means operable to open and close said orifices upon a predetermined pressure differential between the pressure of the treatment medium and the pressure of the medium to be discharged in the area of said cover means during operation.

5. A treatment and discharge system according to claim 4, wherein said cover means includes an elastic cover member positioned over said orifices to cover said orifices, said cover member being deformable to uncover said orifices upon the pressure of the treatment medium exceeding the pressure of the medium to be discharged adjacent said orifices.

6. A treatment and discharge system according to claim 3, wherein said orifices are distributed over the entire length of said agitating and treating means.

7. A treatment and discharge system according to claim 1, wherein said agitating and treating means includes at least one agitating arm rotatably coupled to said container, said at least one agitating arm having said at least one orifice.

8. A treatment and discharge system according to claim 7, wherein said agitating and treating means with said at least one orifice comprises a plurality of arms with a first arm substantially sweeping the entire container bottom, and an additional second, shorter arm extending perpendicular to said first arm.

9. A treatment and discharge system according to claim 1, wherein said agitating and treating means includes two agitating arms rotatably coupled to said container, said agitating arms having said at least one orifice.

10. A treatment and discharge system according to claim 9, wherein said agitating arms are fixedly connected to said discharge pipe through said outlet of said container such that said discharge pipe rotates with said agitating arms.

11. A treatment and discharge system according to claim 10, wherein said agitating arms are connected to said discharge pipe by upright members which extend through said axial outlet.

12. A treatment and discharge system according to claim 11, wherein said feeding means includes a first inlet orifice in said discharge pipe for receiving the treatment medium, and a feed channel vertically disposed in said discharge pipe and fluidly connected between said first inlet orifice and said at least one orifice in said agitating arms.

13. A treatment and discharge system according to claim 12, wherein said feeding means further includes a stationary annular channel sealed to said discharge pipe adjacent said inlet orifice of said discharge pipe.

14. A treatment and discharge system according to claim 13, wherein said stationary annular channel is divided by a web into an outer annular channel and an inner annular channel, said outer annular channel being fluidly connected to said inner annular channel by a passage through said web.

15. A treatment and discharge system according to claim 14, wherein said feeding means includes another feed channel fluidly connected to said at least one orifice in said agitating arms, and another inlet orifice in said discharge pipe for fluidly connecting said inner annular channel to said another feed channel.

16. A treatment and discharge system according to claim 15, wherein said discharge pipe includes a pair of guide surfaces fixedly coupled to said discharge pipe adjacent said upright members to form said feed channels between said guide surface and said upright members.

17. A treatment and discharge system according to claim 9, wherein said agitating arms are provided with conveying scoops for conveying the medium to be discharged in said container.

18. A treatment and discharge system according to claim 17, wherein said conveying scoops are curved for conveying the medium to be discharged inwardly.

19. A treatment and discharge system according to claim 17, wherein said conveying scoops are spaced radially apart along the length of said agitating arm.

20. A treatment and discharge system according to claim 9, further including conveying ribs on said discharge pipe projecting inwardly from an inner wall of said discharge pipe into its free interior space, and said conveying ribs extending downwardly beyond the lower end of said discharge pipe.

21. A treatment and discharge system according to claim 10, further including a deflector disposed on said agitating arms above a portion of said discharge pipe to prevent the medium to be discharged from flowing directly into said discharge pipe from above.

22. A treatment and discharge system according to claim 10, further including a treatment portion coupled to said discharge pipe and an inlet orifice in said treatment portion for adding additional treatment medium.

23. A treatment and discharge system according to claim 13, wherein said stationary annular channel is sealed to said discharge pipe by at least one stuffing box positioned so that the treatment medium lubricates and cools the annular channel.

24. A treatment and discharge system according to claim 1, further including drive means having a crown gear fixedly coupled to said discharge pipe, and a motor with a pinion gear coupled to said crown gear for rotating said discharge pipe and said agitating and treating means.

25. A treatment and discharge system according to claim 24, wherein said crown gear is rotatably supported by a ring support.

26. A treatment and discharge system, comprising:

a container for receiving a medium to be discharged, said container having an inlet, a bottom wall and an axial outlet;

a rotatable discharge pipe axially disposed in said axial outlet;

agitating and treating means, located in said container adjacent said outlet and fixed to said discharge pipe, for agitating the medium to be discharged and for dispensing a treatment medium into the medium to be discharged, said agitating and treating means having at least one orifice for dispensing the treatment medium;

feeding means, fluidly coupled to said agitating and treating means, said feeding means including a stationary feed channel surrounding and sealed to said discharge pipe for supplying the treatment medium to said at least one orifice; and obturator means, coupled to said agitating and treating means, for opening and closing said at lest one orifice.

27. A treatment and discharge system, comprising:

a container for receiving a medium to be discharged, said container having an inlet, a bottom wall and an axial outlet;

a rotatable discharge pipe axially disposed in said axial outlet;

agitating and treating means, located in said container adjacent said axial outlet and fixed to said discharge pipe such that said agitating and treating means rotates with said discharge pipe, for agitating the medium to be discharged and for dispensing a treatment medium into the medium to be discharged, said agitating and treating means having at least one orifice for dispensing the treatment medium;

feeding means, fluidly coupled to said discharge pipe and said agitating and treating means, for supplying the treatment medium to said at least one orifice, said feeding means including a first inlet orifice in said discharge pipe for receiving the treatment medium, and a feed channel vertically disposed in said discharge pipe and fluidly connected between said first inlet orifice and said at least one orifice in said agitating and treating means; and obturator means, coupled to said agitating and treating means, for opening and closing said at least one orifice.

28. A treatment and discharge system according to claim 27, further including valve means for controlling the flow of the treatment medium to said at least one orifice;

pressure sensor means for sensing a pressure in said system; and a control unit operatively connected to said valve means and said pressure sensor to actuate said valve means.

29. A treatment and discharge system according to claim 27, wherein said feeding means includes a stationary annular channel sealed to said discharge pipe.

30. A treatment and discharge system comprising:

a container for receiving a medium to be discharged, said container having an inlet, a bottom and an outlet;

agitating and treating means, located in said container adjacent said outlet, for agitating the medium to be discharged and for dispensing a treatment medium into the medium to be discharged, said agitating and treating means having at least one orifice for dispensing the treatment medium;

feeding means, fluidly coupled to said agitating and treating means, for supplying the treatment medium to said at least one orifice;

obturator means including a cover means coupled to said agitating and treating means, for opening and closing said at least one orifice upon a predetermined pressure differential between the pressure of the treatment medium and the pressure of the medium to be discharged in the area of said cover means during operation; and said cover means including an elastic cover member positioned over said at least one orifice to cover said at least one orifice and being deformable to uncover said at least one orifice upon the pressure of the treatment medium exceeding the pressure of the medium to be discharged adjacent said at least one orifice.

* * * * *